United States Patent [19]

Shafer

[11] Patent Number: 4,858,700

[45] Date of Patent: Aug. 22, 1989

[54] ARTICULATED APPARATUS FOR POSITIONING ROCK DRILLS

[76] Inventor: James P. Shafer, 22 Maple La., Elkview, W. Va. 25071

[21] Appl. No.: 66,432

[22] Filed: Jun. 26, 1987

[51] Int. Cl.[4] ..... E21B 7/02

[52] U.S. Cl. ..... 173/22; 173/43

[58] Field of Search ..... 173/39, 22, 28, 42–44; 248/647, 654

[56] References Cited

U.S. PATENT DOCUMENTS

| | | | |
|---|---|---|---|
| 3,481,409 | 12/1969 | Westerlund | 248/16 |
| 3,565,184 | 2/1971 | Gustafsson | 173/28 |
| 3,721,304 | 3/1973 | Hanson | 173/2 |
| 3,823,902 | 7/1974 | Bumueller | 173/43 |
| 3,922,017 | 11/1975 | Cobb | 173/43 |
| 4,199,033 | 4/1980 | Van Gundy, Jr. | 173/27 |
| 4,288,056 | 9/1981 | Bergstrom | 248/542 |

OTHER PUBLICATIONS

Brochure on Komatsu PC120-3 Hydraulic Elevator.
Brochure on Atlas Copco ROC 820H All-Hydraulic Production Drill Rig.
Brochure on LeRoi Lion I Hydraulic Crawler Rig.

*Primary Examiner*—Frank T. Yost
*Assistant Examiner*—James L. Wolfe
*Attorney, Agent, or Firm*—Pollock, Vande Sande & Priddy

[57] ABSTRACT

Disclosed is an articulated apparatus for positioning a rock drill comprising a self-propelled vehicle having a chassis propelled by endless tracks, a carriage for carrying an engine for driving the tracks, and a rotary drive for power actuated rotation of the carriage relative to said chassis through a full 360° about an upright first axis. A boom is mounted with one end at the carriage for power actuated pivoting thereon about a second axis perpendicular to the upright first axis. An arm is carried by another end of the boom for power actuated pivoting thereon about a third axis parallel with the second axis. A feedshell is provided for guiding and reciprocating a rock drill toward and away from a drill point entry location adjacent to one end of the feedshell. The feedshell is mounted at the distal end of the arm by a feedshell pivot member for power actuated pivoting of the feedshell about a fourth axis parallel with the second and third axes, and for power actuated pivoting of the feedshell about a fifth axis to tilt the feedshell in a plane perpendicular to a plane defined by articulation of the boom and the arm, the fifth axis being perpendicular to the second, third and fourth axes.

14 Claims, 5 Drawing Sheets

ARTICULATED APPARATUS FOR POSITIONING ROCK DRILLS

TECHNICAL FIELD

This invention relates to mobile rock drill rigs which includes means for moving a rock drill into different drilling orientations. More particularly, the invention provides a hydraulically operated rock drill apparatus for attachment to the boom of a backhoe or the like capable of 360° of rotation in the horizontal plane.

BACKGROUND OF THE INVENTION

Hydraulic rock drill rigs in the past have had a relatively restricted range of movement, thereby substantially limiting the pattern for entry of the long drill rod carrying the drill bit at its outer tip. For example, entry patterns in the vertical plane may be limited to a maximum swing of about 90° and a maximum reach in this plane of about 5 feet. Similarly, the entry pattern for drilling in the horizontal plane may be limited to a range of swing toward the front of the drilling rig so that holes may be drilled only in a forward direction, such as a forward entry pattern falling within a concave rectangle no more than 10 feet high and 30 feet wide.

While it has been proposed in U.S. Pat. No. 4,199,033 to Gundy to provide an augering attachment for a backhoe, the distance that the tip of the auger extends beyond the distal end of the boom is fixed, and the swiveling connection for attaching the auger to the distal end of the boom is not sufficiently sturdy to endure the stresses generated by the pounding of a percussive rock drill. In addition, the boom to which the auger is attached is limited to a pivotal movement toward the rear of the backhoe tractor.

DISCLOSURE OF THE INVENTION

The present invention overcomes the foregoing limitations of the prior art. Accordingly, an object of the present invention is to provide a self-propelled, highly mobile carrier having an articulated apparatus for positioning a hydraulic rock drill within an unusually wide range of horizontal, vertical, tilted and intermediate drilling positions.

A further objection of the invention is to provide a rugged and sturdy apparatus for attachment of a hydraulic rock drill to the hydraulically operated boom of a machine for earth excavation having a tractor platform capableof 360° of rotation in the horizontal plane, such as a backhoe with a cab mounted on a platform having a rotary plate assembly.

Another objection of the invention is the provision of a rock drill attachment apparatus which is capable of replacing the bucket of a backhoe of the aforesaid type and can be secured to the boom of such a backhoe by the same means as conventionally provided for securing the backhoe bucket.

A further object of the invention is the provision of a rock drill apparatus capable of swinging the rock drill feedshell through about 240° in a boom articulation plane and through about 360° in the horizontal plane, of pivoting the rock drill feedshell relative to the distal end of the boom on which it is mounted through about 190° in a boom articulation plane, and of tilting the rock drill feedshell through an angle of at least about 44° in a plane of articulation perpendicular to the plane of articulation of the boom on which the feedshell is mounted.

Another object of the invention is to provide a rock drill apparatus that may be articulated out of the plane of the boom for attachment to an articulated boom configuration permitting the drill rod to be positioned down into an excavation beneath the level of the tractor to which the boom is attached so as to permit drilling directly under, as well as below grade toward either side, of the tractor.

Still another object of the invention is to increase by a factor of at least 2 and preferably at least 3, the reach of rock drills to provide for vertical entry through a horizontal plane over a range greatly improved relative to the reach pattern of conventional rock drill rigs.

Yet another object of the invention is to provide an ergonomic arrangement for operating a rock drill assembly from a cab positioned for improved visibility of the drilling operation and providing for the comfort, convenience, ease of operation, safety of the operator and reproduction of operator fatigue.

Still a further object of the invention is to provide a rock drill assembly capable of executing both horizontal and vertical drilling forward, behind, beside, above and underneath a mobile tractor rig on which the drill assembly is mounted.

A further object of the invention is to provide an articulated apparatus for positioning rock drills of a length from less than 10 feet to more than 50 feet for single pass drilling.

Other objects of the invention include provision of a feedshell structure having a tubular configuration for increased strength with less weight; provision of a slab-back assembly for mounting rock drill motors and associated components on rollers for traveling along the feedshell track, thereby providing smoother operation and lower maintenance costs; provision of a feedshell assembly, the drilling end of which is stabilized by a single point carbide foot which is adjustable by extension of the foot relative to the feedshell, thereby stabilizing an articulated boom and feedshell throughout the range of positions provided for drill point entry; provision of a feedshell assembly having a continuous circuit chain for feeding drill motors mounted on a slab-back assembly and including a chain tensioning device providing for simple and quick adjustment of chain tension; provision of a feedshell pivot assembly that is capable of pitching the feedshell through at least about 190° relative to the distal end of the boom on which the feedshell is mounted and in a plane offset from and parallel to the boom articulation plane; provision of a feedshell offset to one side of an articulated boom so that an overlapping portion of the feedshell may pivot past the boom without interference; and provision of a feedshell pivot assembly which is articulated relative to the distal end of an articulated boom on which it is mounted so as to provide tilting movement out of the plane of articulation of the boom by at least about 44°, and by as much as about 180°.

BRIEF DESCRIPTION OF THE DRAWINGS

The features and operation of the invention may be further understood from the description below of specific embodiments taken in conjunction with the accompanying drawings in which.

DESCRIPTION OF BEST MODE AND OTHER EMBODIMENTS

Figure 1:
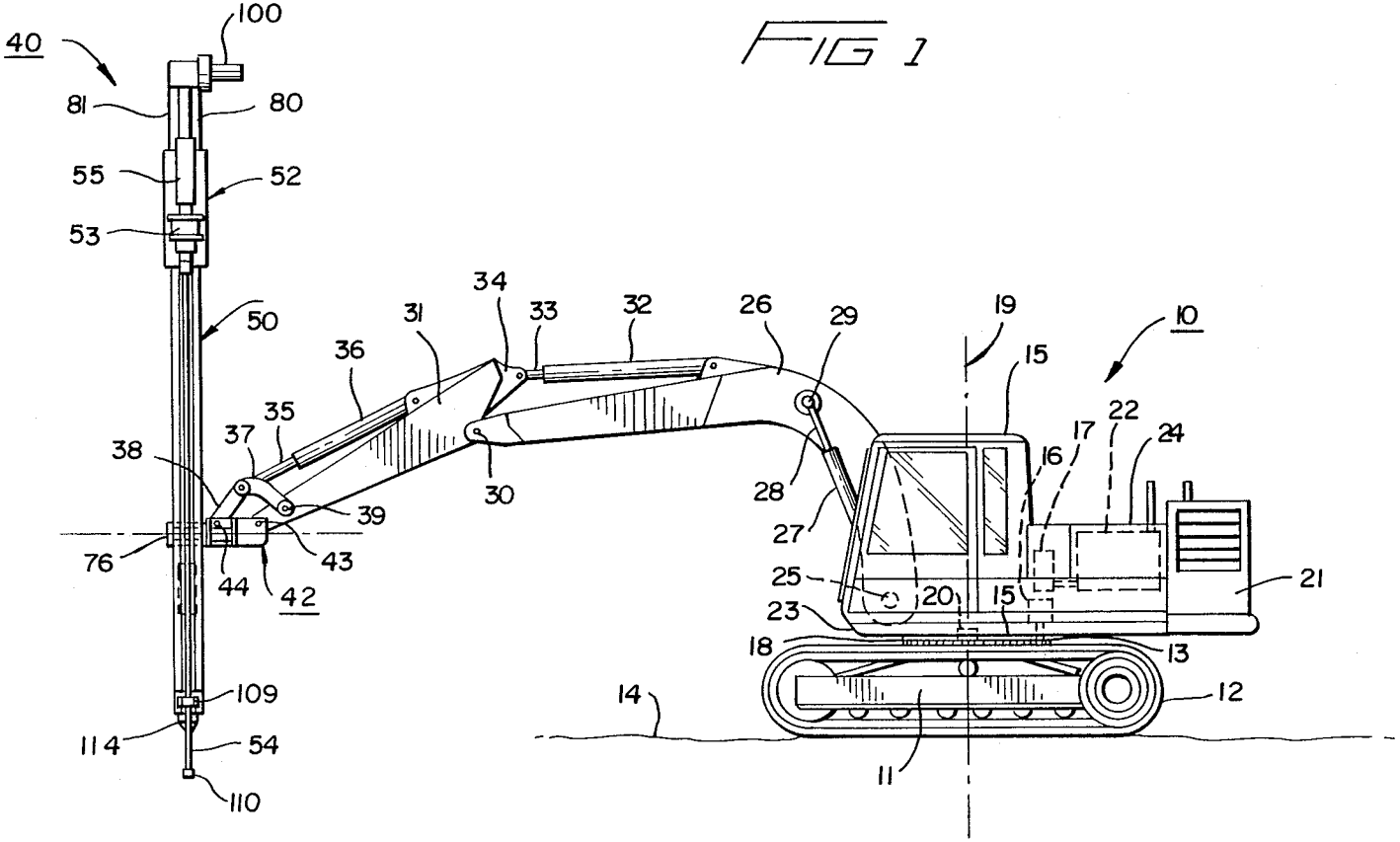
FIG. 1 is a side elevational view of the apparatus of the invention with the rock drill assembly in a vertical position.

The articulated rock drilling apparatus shown in the drawings comprises a self-propelled carrier, generally designated 10, having an undercarriage 11, with a pair of parallel tracks 12—12 for providing travel over the ground 14. An operator cab 15 is carried on a carriage platform 23 which is rotationally mounted for 360° of rotary movement relative to undercarriage 11 through a rotary bearing plate 17 rotatably receiving an upstanding axle 20 carried on a gear plate 18 fixed to undercarriage 11. Gear teeth may be provided on the periphery of gear plate 18 for engagement by a gear 13 driven by a hydraulic motor 16 for causing rotational movement of platform 23 around a vertical axis 19. Hydraulic motor 16 may be driven by a hydraulic pump 17 which in turn may be driven by a drive shaft powered by a diesel engine 22.

Also mounted on platform 23 of vehicle 10 are an air compressor unit 21 and a housing 24 for diesel engine 22 and related hydraulic pumps, such as pump 17, for driving the other powered components described below. Tracks 12—12 may be driven by a hydraulic motor similar to motor 16, or by a direct drive train having appropriate drive shafts and gearing. Air compressor 21 provides air through a flexible air line (not shown) to the rock drill assembly, this air line terminating at an air nozzle adjacent to the drill bit for providing flushing air to blow drill cuttings out of the hole being drilled into a rock mass.

Mounted on rotary platform 23 of vehicle 10, through a pivot pin 25, is a boom 26 whose inclination in a vertical plane is controlled between two limit positions L1 and L2 (FIG. 3) by means of a pair of pivotally mounted cylinders 27—27 pivotally connected at 29 to boom 26 by a pair of connecting rods 28—28. Unless otherwise indicated, all cylinders and motors are hydraulically operated and all cylinders contain a double acting piston for power actuation of the corresponding connecting rod. Flexible hydraulic lines are provided for fluid communication between cylinders and motors on the one hand and their corresponding lines having been omitted from the drawings for clarity.

The boom 26 carries at its distal end, through a pivot pin 30, a dipper arm 31 which is adjustable relative to boom 26 through an angle between two limit positions L3 and L4 (FIG. 3) by means of a pivotally mounted cylinder 32 having a rod 33 pivotally connected to an articulate end 34 of arm 31. The arm 31 thus comprises a lever rotatable about pivot pin 30, and carries a third pivotally mounted cylinder 36 having a rod 35 pivotally connected to two pairs of links 37—37 and 38—38. The pair of links 37—37 are pivotally connected by a pivot pin 39 to a distal end portion of arm 31.

The self-propelled vehicle 10 (excluding air compressor 21), boom 26, arm 31 and the linkages, cylinders and rods up through links 37—37 and 38—38 are components of a conventional unit of the type generally known in the art of earth moving equipment as a backhoe, such as the model PC120-3 hydraulic excavator available from Komatsu Ltd. of Japan. Such earth moving excavators are generally provided with a diesel motor and such hydraulic fluid pumps as needed to operate hydraulic cylinders such as 27—27, 32 and 36. The vehicle 10 of the present invention also includes such hydraulic pumps and flexible hydraulic lines as are needed to provide sufficient pressurized hydraulic fluid for operating the hydraulic motors and cylinders of the rock drill assembly, generally designated 40. The hydraulic pumps powered by the diesel of vehicle 10 are preferably of the variable displacement type. Instead of operating the hydraulic units off of the diesel engine 22, at least some of these units may be operated off air compressor 21 by converting pneumatic fluid energy to hydraulic form by suitable air motors powering hydraulic pumping units, all of which may be mounted on the platform 23 of vehicle 10.

Figure 3:
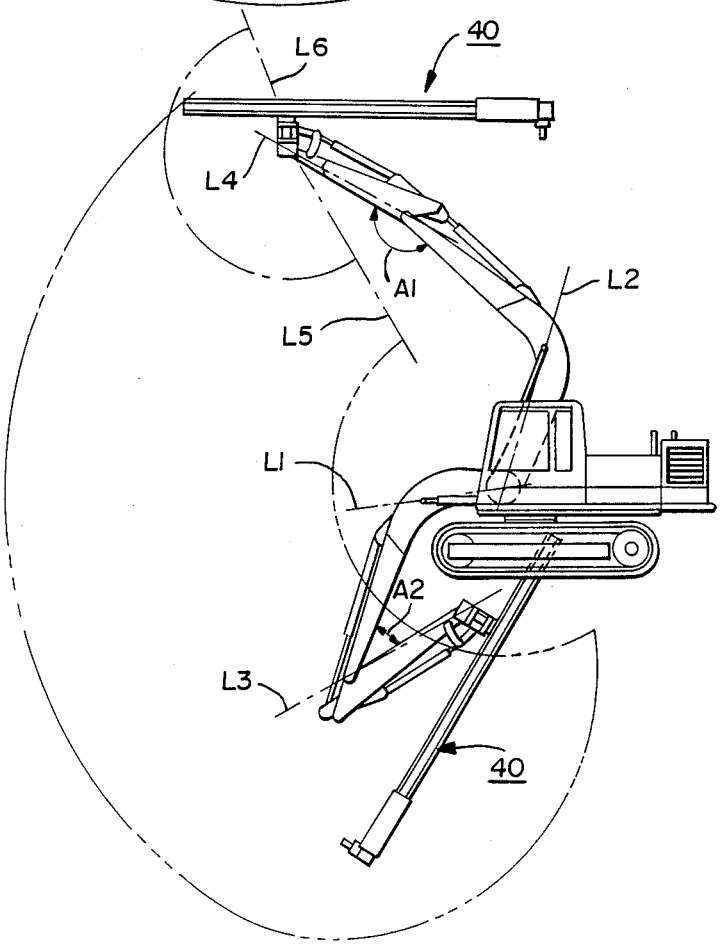
FIG. 3 is a side elevational view of the apparatus of the invention illustrating diagrammatically the range of swing and range of pivot of the rock drill assembly in the vertical plane.

The links 37—37 and 38—38 may be conventional bucket links for mounting a backhoe bucket on the distal end of dipper arm 31. In place of the usual bucket, the present invention provides a feedshell pivot member 42 pivotally connected to the distal end of arm 31 by an arm pivot pin 43 and pivotally connected to the distal ends of links 38—38 by a link pin 44. The linkages and connections thus provided between arm 31 and pivot member 42 provide for a pivot range of motion of the rock drill assembly 40 in the vertical plane between an inward limit position L5 and an outward limit position L6, which are preferably at least substantially 180° apart, more preferably at least substantially 190° apart, as illustrated in FIG. 3.

Figure 6:
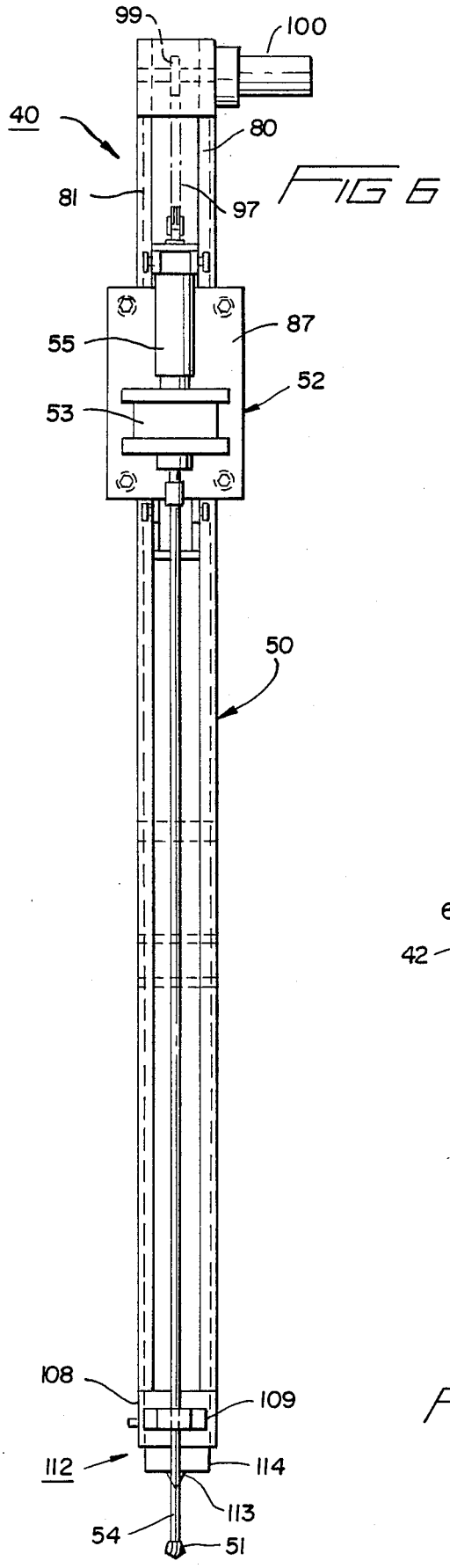
FIG. 6 is a left side elevational view of the rock drill assembly of FIG. 1.
Figure 7:
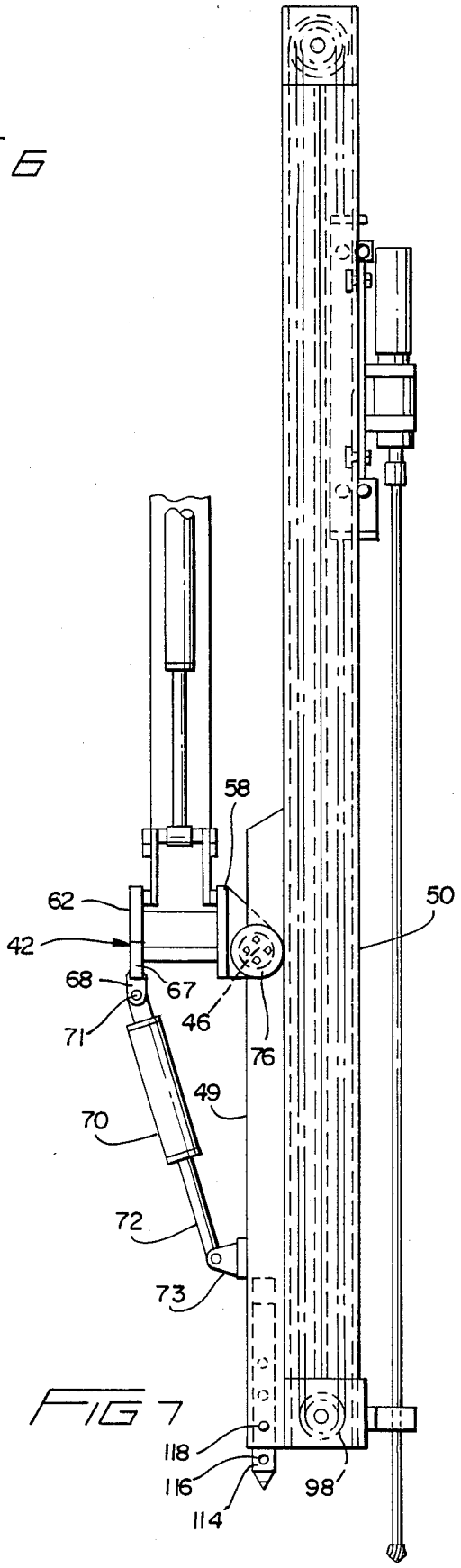
FIG. 7 is a fragmentary front elevational view showing details of the mechanism for tilting the rock drill assembly out of the articulation plane of the boom; and, FIG. 8 is a perspective view showing details of the feedshell pivot member for providing pivotal movement of the rock drill assembly in a plane parallel to the articulation plane of the boom and side to side tilting movement of the rock drill assembly in a plane perpendicular to the articulation plane of the boom.
Figure 8:
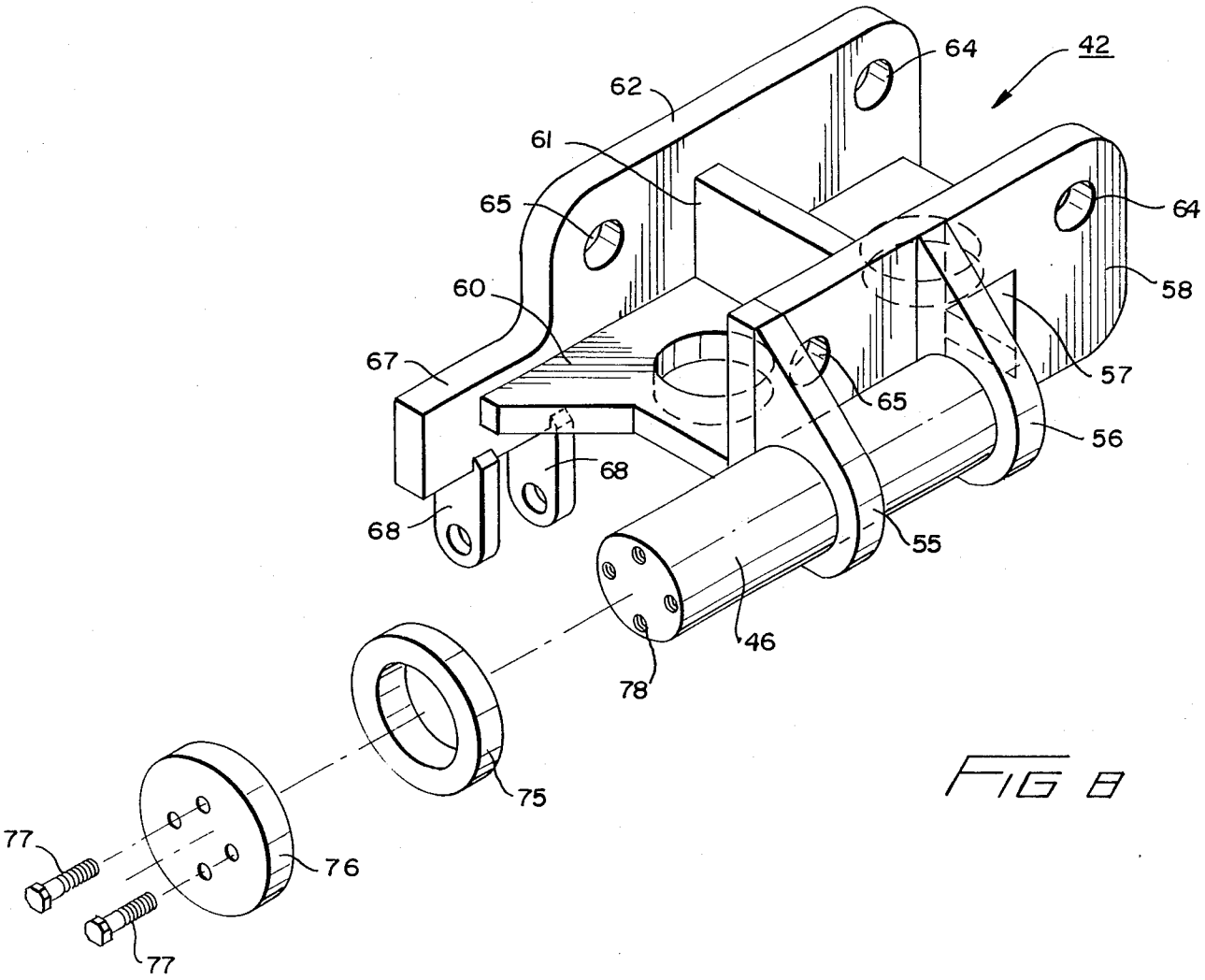

Referring now to FIGS. 6–8, the feedshell pivot member 42 includes a pivot pin 46 on which is pivotally carried a collar 48 fixed to a tilting member 49 which in turn is fixedly secured to a feedshell assembly 50, which provides a track for a slab-back assembly 52 on which is mounted a rotary drill motor 53 and a percussive drill motor 55. Pivot pin 46 is secured to the body of pivot member 42 by an intermediate lateral plate 55, and a rear lateral plate 56 and a triangular brace plate 57, all of which are welded to a left link plate 58. Connected the left link plate 58 by a base plate 60 and brace plate 61 is a right link plate 62. The right and left link plates contain apertures 64—64 for rotatably receiving arm pivot pin 43, and apertures 65—65 for rotatably receiving link pivot pin 44.

Right link plate 62 includes a forwardly projecting extension 67 which carries a pair of depending mounting brackets 68—68 to which is pivotally secured a hydraulic tilt cylinder 70 by a pin 71. Collar 48 is positioned for rotation on pivot pin 46 by a thrust ring 75 and is held in position by a thrust plate 76 which is fastened to the outer end of pin 46 by four bolts 77 which are threaded into four countersunk holes 78 in the end of pin 46. The inside diameter of collar 48 is slightly larger (for example, by 5 mils) than the outside diameter of pin 46 so as to provide a slip fit for receiving a grease type lubricant. Both pin 46 and collar 48 are made of a hardened steel material satisfactory for mutually sliding bearing surfaces.

Figure 4:
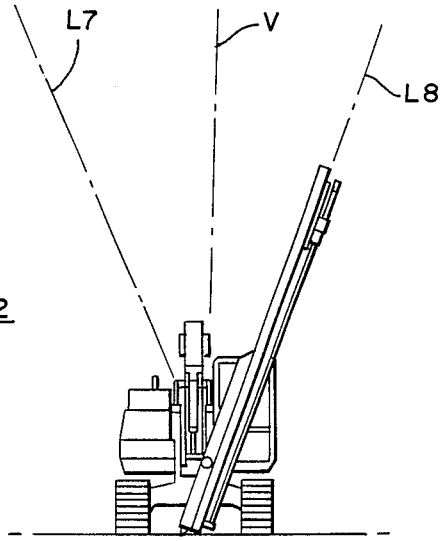
FIG. 4 is a front elevational view of the apparatus of the invention illustrating diagrammatically the range of tilt of the rock drill assembly in a plane perpendicular to the articulation plane of the boom.

Rod 72 of the double acting piston in cylinder 70 is pivotally connected to tilting member 49 by an ear type bracket 73 so that extension and retraction of rod 72 causes rock drill assembly 40 to tilt transversely from side to side in a plane perpendicular to the articulation plane through the longitudinal axes of boom 26 and articulated arm 31 as seen best in FIG. 4. The travel of rod 72 relative to cylinder 70 is preferably sufficient to provide a range of tilt from a right side limit L7 to a left side limit L8, L7 being about 24° and L8 about 20° from the plane V, which is parallel to the articulation plane of the boom. By using a throw linkage, similar to links 37—37 and 38—38, in place of ear 73, the range of vertical tilt between limits L7 and L8 may be increased to about 180°. However, the tilt range between L7 and L8 is preferably substantially at least 44°, which is entirely satisfactory for most applications of a rock drilling apparatus.

Figure 5:
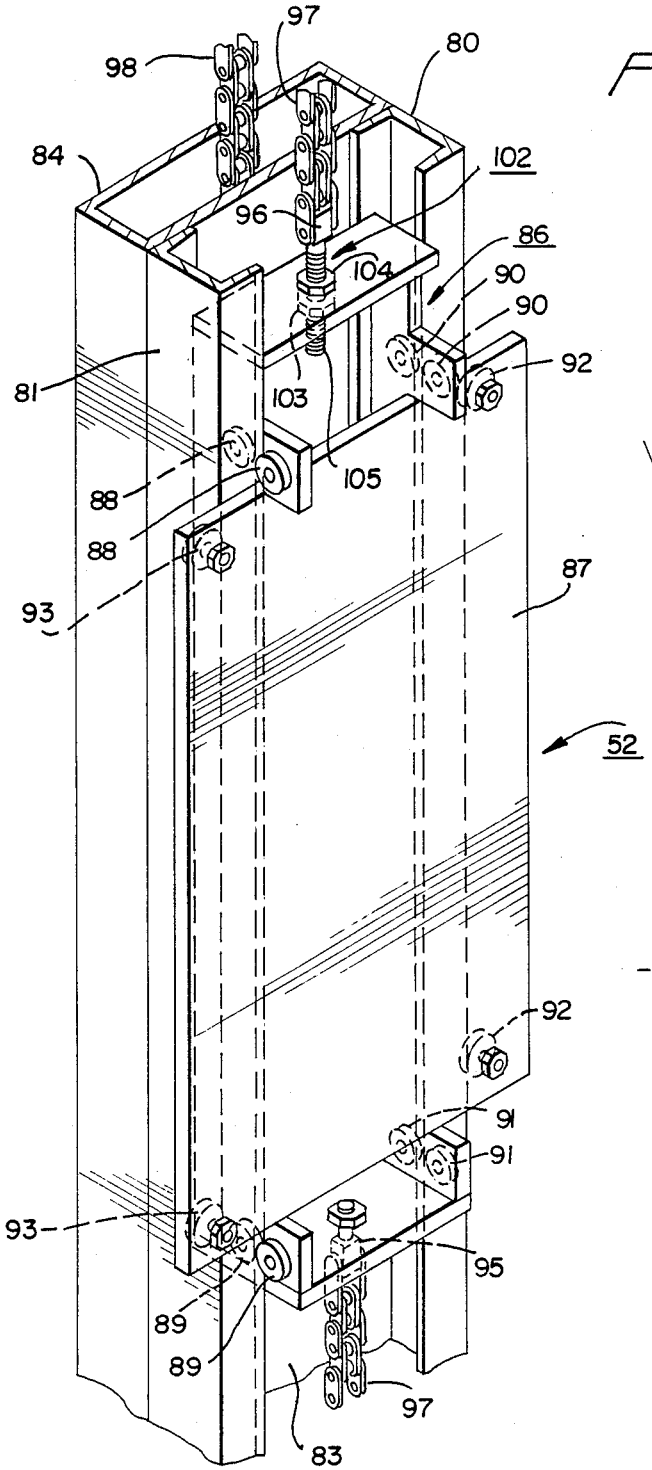
FIG. 5 is a fragmentary perspective view in partial section of the slab-back assembly for reciprocating the drill motors and the chucked end of the drill rod along the track of the feed shell assembly, the drill motors and rod being removed for clarity.

Referring now to FIGS. 5 and 6, the features of the feedshell assembly 50 and the slab-back assembly 52 are shown in more detail. The feedshell assembly includes a track provided by a pair of parallel rails 80 and 81 each formed by a U-shaped channel member mounted on a major surface 83 of a rectangular feedshell support tube 84, rail 81 being forward of rail 80 relative to vehicle 10. Arranged to travel up and down the rails 80 and 81 is the slab-back assembly 52 which has a carriage 86 on which is mounted a platform 87. Rotatably mounted on the carriage are four pairs of rollers 88—88, 89—89, 90—90 and 91—91, rollers 88—88 and 89—89 engaging track 80 and rollers 90—90 and 91—91 engaging track 81, and one roller of each pair engaging the outer track surface and the other engaging the inner track surface. Platform 87 also carries two pairs of rollers 92—92 and 93—93, rollers 92—92 engaging the outer face of the web of rearward rail 80 and rollers 93—93 engaging the outer face of the web of forward rail 81 to provide lateral stability to the slab-back assembly.

At the lower end of carriage 86 is a fixed chain eye 95 and at the upper end of the carriage is an adjustable chain eye 96 for connecting the slab-back assembly 52 between the respective ends of a drive chain, which has an outer run 97 and an inner run 98 and makes a continuous circuit by passing around an idler pulley 98 and a drive pulley 99. Idler pulley 98 is rotatably mounted adjacent to the bottom end of the feedshell track, and drive pulley 99 is rotatably mounted adjacent to the top end of the track where it is driven by a feed motor 100. The tension in chain 97–98 is adjustable by a chain tensioning device, generally designated 102, comprising an adjusting nut 103 and a jam nut 104 threaded onto the threaded shank 105 of adjustable chain eye 96.

Mounted upon the platform 87 of slab-back assembly 52 by appropriate brackets, bolts, and nuts (not shown) is the drill drive means which is of the rotary-percussion type and includes both a rotary motor component 53 for rotating and a percussive motor component 55 for cyclically impacting the elongated drill rod 54 so as to drive the drill bit 110 into a solid mass of rock.

At the lower end of the feedshell assembly 50 mounted on a plate 108 adjacent to idler pulley 98 is a centralizer bearing member 109 for journalling and aligning the rotating drill rod 54 which has one end chucked in drill motor 53 and a drill bit 110 at its opposite end. Rod 54 reciprocates drill bit 110 beyond centralizer 109 as slab-back assembly 52 travels up and down the rails 80 and 81 of feedshell 50. To increase the stability of the feedshell assembly as drill rod 54 penetrates a rock mass, a single point carbide foot 112 is slidably mounted in a rectangular channel within tilting member 49. To provide this channel, member 49 may be made from a rectangular tube similar to feedshell support tube 84. The foot 112 includes a single carbide point 113 carried on a slidable shaft 114 having a series of apertures 116 for receiving an adjustment pin 118 which adjustably locks the foot 112 in a fixed position at the bottom end of feedshell 50. This adjustment feature allows firmly anchoring the bottom end of the feedshell assembly irrespective of the contour of the rock face in which the drill bit 110 is to enter as the slab-back assembly moves away from feed motor 100 at the top end of feedshell 50.

Because of the dimensions of the slab-back assembly and the drill motors mounted thereon, the length of the feedshell tracks 80 and 81 is preferably about three feet longer than the length of travel provided for the drill rod 54. By way of example, the length of drill rod 54, may vary from less than about 10 feet to more than about 50 feet, depending on the depth of the holes to be drilled in a rock mass.

Also by way of example, the tracks 80 and 81 may span a distance of about 8 inches and have channel webs about 3 inches in height. The sides of the feedshell support tube 84 may be 4 inches in height to provide a total feedshell thickness of 7 inches. The slab-back assembly may include a carriage 86 that is $4\frac{3}{4}$ inches in width and $38\frac{1}{2}$ inches long, and a platform 87 made from a plate that is 27 inches long by $11\frac{1}{2}$ inches wide by $\frac{7}{8}$ inch thick.

For attachment to the PC120-3 hydraulic excavator of Komatsu, Ltd., the feedshell pivot member 42 may comprise link pin apertures 65—65 spaced 15 inches forward of arm pin apertures 64—64, and right link plate 62 may be spaced laterally from left link plate 58 by a distance of $10\frac{1}{4}$ inches. Each of these plates may be $1\frac{1}{2}$ inches in thickness and $10\frac{1}{2}$ inches in width. The thickness of plates 55, 56, 57, 60 and 61 also may be $1\frac{1}{2}$ inches. The spacing between intermediate mounting plate 55 and rear mounting plate 56 may be 8 inches, and pin 46 may be 5 inches in diameter and project forwardly beyond intermediate mounting plate 55 by a 9 inches. Thrust ring 75 may be 1 inch thick such that the axial length of collar 48 is 8 inches and this collar may be held in place by a 1 inch thick end plate 76. Both ring 75 and plate 76 may be 7 inches in diameter. The extension 67 for mounting cylinder brackets 68—68 may project forwardly beyond intermediate mounting plate 55 by $7\frac{5}{8}$ inches. The overall length of pin 46 may be $18\frac{1}{2}$ inches.

The feedshell tilt member 49 may be a 4 inch by 8 inch rectangular tube, similar to feedshell tube 84, and may be cut to a length of 80 inches. The center axis of collar 48 may be 56 inches from the lower end of tilt member 49 and the pivot axis of ear 73 may be $21\frac{1}{2}$ inches from the lower end of tilt member 49. These relative positions of the pivot axes of tilt cylinder 70 and pivot pin 46 will provide a tilt range of at least substantially 44° as previously discussed with reference to FIG. 4.

The apparatus of the invention operates as follows. Reciprocation of piston rods 28—28 by cylinders 27—27 will most preferably move the main boom 26 through an arc in the boom articulation plane of at least substantially 109° as indicated by limit lines L1 and L2 in FIG. 3. The reciprocation of piston rod 33 by cylinder 32 will most preferably move arm 31 through an arc in the boom articulation plane of at least substantially 131° relative to the longitudinal axis of boom 26. Accordingly, the distal end of arm 31 is movable through a total arc in the boom articulation plane from limit L3 to limit L4 of at least substantially 240° as shown in FIG. 3. For this range of motion, arm 31 moves relative to boom 26 from an angle A1 of substantially 168° to an angle A2 of substantially 37°. In addition to this vertical swing angle, reciprocation of the piston rod 35 by cylinder 36 provides most preferably a pivot range in the plane V parallel to the boom articulation plane between limit lines L5 and L6 of at least substantially 190°.

Figure 2:
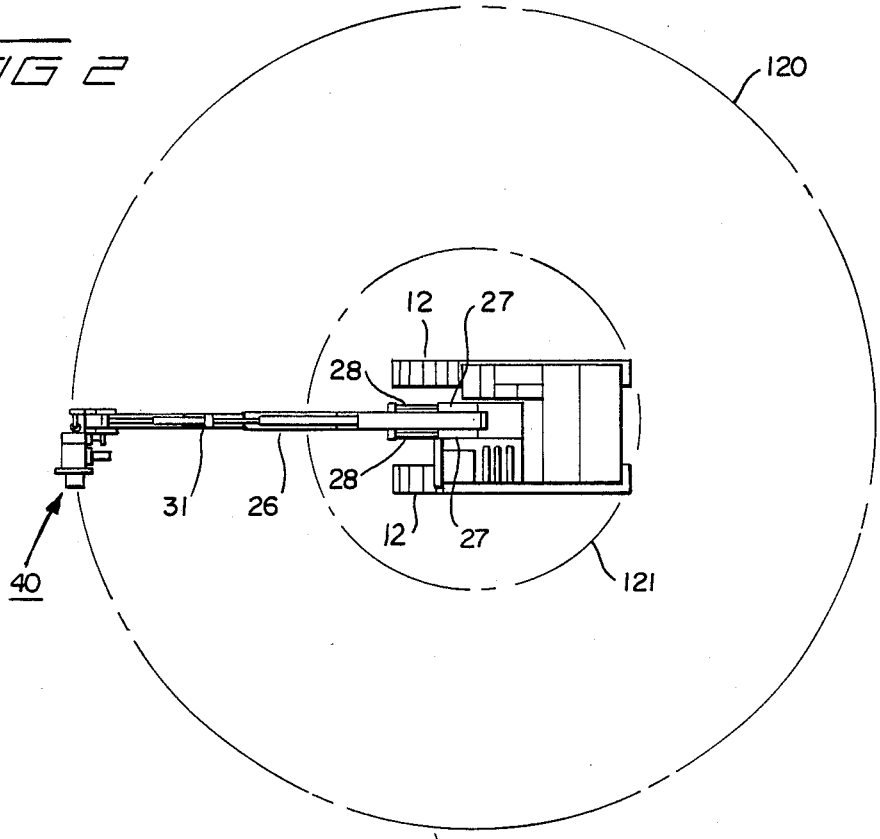
FIG. 2 is a plan view of the apparatus of the invention with the rock drill assembly in the vertical position of FIG. 1, and illustrating diagrammatically the 360° horizontal swing of the rock drill.

With reference to FIG. 2, the carrier platform 23, as rotatably mounted relative to tracks 12—12 of vehicle 10 preferably provides a horizontal swing for a full 360°. The width of the annular ring defined between broken lines 120 and 121 of FIG. 2 represent the translational reach of drill assembly 40 from a retracted position, which may be about 5 feet in front of the tracks 12—12 to an extended position, which may be about 19 feet from the front of the tracks 12—12, for a total reach of about 14 feet in the horizontal plane. Where the rotational axis 19 of platform 23 is 5½ feet from the front of the tracks 12—12, the overall diameter of the circle circumscribed by the drill assembly when in its fully extended reach position of FIG. 2 may be about 49 feet.

The centralizer 109 holds the rotating drill rod 54 in a central alignment with the longitudinal axis of feedshell 50 as the drill motors 53 and 55 are caused to travel either inward or outward on the slab-back assembly 52 by the chain drive of feed motor 100. Outward travel feeds the drill bit into a rock mass being drilled. Inward travel then reversibly extracts the drill rod and finally the drill bit from the drilled hole cut in the rock mass by the rotative and percussive action of the drill bit. This drilling action is provided by drill motor 53 which is operable to rotate elongated drill rod 54 and to deliver therethrough percussive blows to the drill bit 51. The feedshell 50 thus comprises a track for reversibly feeding the drill motor therealong as the drill bit passes into the rock mass being drilled. The slab-back assembly 52 thus comprises a carriage guided by the feedshell track to hold the drill chuck at motor 53 in proper alignment with the guiding action provided by centralizer 109 as the slab-back assembly travels back and forth along the feedshell track.

The direction along which the drill rod passes into the rock being drilled is a function of the wide range of feedshell positions provided throughout the ranges of motions of the articulated apparatus of the invention. These ranges are illustrated best in FIGS. 2–4. As evident from the pivotal range of movement between L5 and L6 in FIG. 3 and as seen best in FIGS. 4 and 7, the feedshell 50 is offset to the left of the distal end of arm 31 so that its top end can pivot back and forth past the arm 31 and boom 26, thus allowing feedshell 50 to achieve an upwardly aligned position along the limit line L6 wherein the top end of the feedshell assembly carrying feed motor 100 is actually below the boom. Thus, the pivotal motion of feedshell 50 is not limited by any interference between the feedshell 50 on the one hand and the arm 31 and boom 26 on the other, provided the upper end of the feedshell tube is not tilted to the right of the plane V which is parallel to the articulation plane in which the arm 31 and boom 26 articulate relative to vehicle 10.

The controls for the hydraulic pumps, valves and distributors for operating all of the power actuating and driving components are placed in the cab 15 of the vehicle 10 and are arranged for the convenience and ergonomics of the operator sitting therein. All of the hydraulic power exercisable through these controls may therefore be provided by a central hydraulic unit of vehicle 10, which preferably includes variable displacement hydraulic pumps for feeding the various hydraulic motors and cylinders.

As illustrated in FIGS. 2–4, movements of boom 26, arm 31, and feedshell 50 enables the rock drilling operation to be carried out from a great plurality of positions. Either very much above the level of the ground on which rest the tracks 12—12 of vehicle 10, or very much under the ground level, such as in a trench or other excavation. The length and width of the tracks 12—12, the spacing between the left and right tracks, and the weight of the vehicle 10 as a whole are such that in any of the positions shown in the drawings, the feedshell 50 provides an unusually stable drilling platform which significantly enhances the accuracy and speed of the drilling operation.

The axis 19 of rotary plate 15 may be considered as a first axis of rotation and the axes of pivots 25, 30, 43, and 46 may be considered respectively as second, third, fourth, and fifth axes of rotation. As illustrated in the drawings, the rotation axes of pivots 25, 30 and 43 are parallel with each other and perpendicular to first rotation axis 19, and the fifth rotation axis of feedshell pin 46 is perpendicular to the second, third and fourth rotation axes of pivots 25, 30 and 43, respectively. The fifth rotation axis of pin 46 may be either perpendicular, parallel or at various intermediate angles to first rotation axis 19. This geometrical configuration, together with the use of the full rotation mechanism of vehicle platform 23 and the ranges of movement of the boom 26, the arm 31, and the feedshell 50, makes it possible to adjust the drill rod 54 through the wide range of operating positions illustrated in FIGS. 2–4.

A person skilled in the art will recognize from the foregoing that it would be possible to modify the length, size and shape of the various components in a variety of ways without significantly affecting their functions. Accordingly, while the preferred embodiment has been described in detail by way of example, and is shown in the accompanying drawings, it will be evident that various further modifications are possible without departing from the scope of the invention as defined by the claims below.

What is claimed is:

1. An articulated apparatus for positioning a rock drill comprising:

a vehicle having a chassis supported by ground engaging means, a carriage means mounted on said chassis, and rotary means for power actuated rotation of said carriage means relative to said chassis about an upright first axis;

a boom means mounted with one end at said carriage means for power actuated pivoting thereon about a second axis perpendicular to said upright first axis;

an arm means carried by another end of said boom means for power actuated pivoting thereon about a third axis parallel with said second axis, said power actuated pivoting of said boom means and said arm means defining a plane of boom articulation;

an elongated feedshell means for guiding and reciprocating a rock drill means toward and away from a drill point entry location adjacent to one end of said feedshell means; and, a feedshell pivot means for mounting said feedshell means on a distal end portion of said arm means for power actuated pivoting of said feedshell means about a fourth axis parallel with said second and third axis, said feedshell pivot means comprising body means pivotally connected to said distal end portion for rotation about said fourth axis and offset means providing an offset connection between said body means and said elongated feedshell means, said offset connection being located at an intermediate position between the ends of said elongated feedshell means and offset to one side of said distal end portion of said arm means to allow said pivoting of said feedshell means in a plane parallel to said plane of boom articulation, the amount of said offset being sufficient for the other end of said elongated feedshell means to swing back and forth past said arm means without interference.

2. The articulated apparatus of claim 1 in which said carrier means is rotatable about said upright axis through substantially a full circle of 360° by the action of said rotary means.

3. The articulated apparatus of claim 2 which further includes a first power-actuated pivot means for swinging said feedshell about said second pivot axis and said third pivot axis through a total angle of at least substantially 180°.

4. The articulated apparatus of claim 3 in which said first power-actuated pivot means includes means for swinging said feedshell about said second pivot axis and said third pivot axis through a total angle of at least substantially 240°.

5. The articulated apparatus of claim 3 which further comprises a second power-actuated pivot means for pivoting said feedshell means about said fourth axis through an angle of at least substantially 180°.

6. The articulated apparatus of claim 5 in which said second power-actuated pivot means includes means for pivoting said feedshell means about said fourth axis through an angle of at least substantially 190°.

7. The articulated apparatus of claim 5 which further comprises a third power-actuated pivot means for tilting said feedshell about said fifth axis through an angle of at least substantially 44°.

8. The articulated apparatus of claim 1 in which said intermediate position of said offset connection is located closer to said one end than said other end of said elongated feedshell means.

9. The articulated apparatus of claim 1 in which said offset means includes journal means for rotation of said elongated shell means relative to said body means such that said offset connection is a pivotal connection, and in which said feedshell pivot means further comprises feedshell power means for power actuated pivoting of said feedshell means about a fifth axis defined by said journal means to provide tilting of said feedshell means in a plane perpendicular to said plane of boom articulation, said fifth axis being perpendicular to said second, third, and fourth axes.

10. The articulated apparatus of claim 9 in which said body means comprises a first plate member, means for connecting said first plate member to said one side of said distal end portion of said arm means, a second plate member, means for connecting said second plate member to another side of said distal end portion of said arm means, and a base plate member connecting said first and second plate members to each other; and in which said offset means comprises a pivot pin having a central axis, means for mounting said pivot pin on said first plate member such that the central axis of said pivot pin coincides with said fifth pivot axis, and means for securing said elongated feedshell means on said pivot pin for rotation about said fifth pivot axis.

11. The articulated apparatus of claim 10 in which said feedshell pivot means further comprises an arm power means for power actuated pivoting of said body means about said fourth axis, and in which said feedshell power means provides power actuated pivoting of said feedshell means about said pivot pin.

12. The articulated apparatus of claim 11 in which said feedshell power means comprises a longitudinally extensible piston and cylinder assembly, means for pivotally connecting one end of said assembly to said second plate member, and means for pivotally connecting the other end of said assembly to said elongated feedshell means.

13. The articulated apparatus of claim 1 in which said ground engaging means is endless, and in which said carriage means carries drive means for driving said endless ground engaging means such that said vehicle is self-propelled.

14. The articulated apparatus of claim 1 in which said carrier means is rotatable about said upright first axis through at least substantially 180°.

* * * * *